US005440992A

United States Patent [19]

Chemiere et al.

[11] Patent Number: 5,440,992

[45] Date of Patent: Aug. 15, 1995

[54] PRIMING AND SELF-DESTRUCT SYSTEM OF A MUNITION

[75] Inventors: Patrice Chemiere, La Chapelle Saint Ursin; Jean-Paul Dupuy, Bourges, both of France

[73] Assignee: Giat Industries, Versailles, France

[21] Appl. No.: 244,076

[22] PCT Filed: Dec. 1, 1993

[86] PCT No.: PCT/FR93/01178

§ 371 Date: May 17, 1994

§ 102(e) Date: May 17, 1994

[87] PCT Pub. No.: WO94/15170

PCT Pub. Date: Jul. 7, 1994

[30] Foreign Application Priority Data

Dec. 18, 1992 [FR] France ..... 92 15313

[51] Int. Cl.[6] ..... F42C 15/22

[52] U.S. Cl. ..... 102/246

[58] Field of Search ..... 102/237, 244, 245, 246

[56] References Cited

U.S. PATENT DOCUMENTS 4,811,664 3/1989 Levy et al. .
5,022,325 6/1991 Skowasch et al. ..... 102/245
5,048,419 9/1991 Skowasch ..... 102/245
5,206,457 4/1993 Pascal et al. ..... 102/235
5,275,101 1/1994 Chemiere et al. ..... 102/245
5,373,790 12/1994 Chemiere et al. ..... 102/226

FOREIGN PATENT DOCUMENTS 0205956 12/1986 European Pat. Off. .
0318997 6/1989 European Pat. Off. .
2379796 9/1978 France .

*Primary Examiner*—Stephen C. Bentley
*Assistant Examiner*—Theresa M. Wesson
*Attorney, Agent, or Firm*—Oliff & Berridge

[57] ABSTRACT

A priming and self-destruct system for a munition having its own rotational movement about a longitudinal axis includes a trigger mounted to pivot about an axis parallel to the rotational axis of the munition under the effect of centrifugal force and against the action of a return spring. The self-destruct system also has a retention device for a secondary firing pin having its own spring in the armed position that is controlled by the trigger when the system is rotating about the axis of the munition. In the event of a malfunction, the secondary firing pin is released by the trigger when the rotation ceases, i.e., when the munition comes to rest on the ground. At that point and without delay, the secondary firing pin pierces the priming system and initiates the munition.

14 Claims, 8 Drawing Sheets

PRIMING AND SELF-DESTRUCT SYSTEM OF A MUNITION

BACKGROUND OF THE INVENTION

The present invention relates to a priming and self-destruct system of a munition, and in particular, to a submunition that rotates around the longitudinal axis of and is designed to be ejected from a cargo shell.

As is well-known in the art, a munition is comprised of a generally cylindrical body that holds the war charge. This body is topped with a casing-box which houses a Safety and Arming Unit (SAU) that comprises the priming and self-destruct system of the munition.

In real terms, the slide which carries the priming system of the charge is housed in the part of the casing box which is next to the war charge, whereas the impact detector is mounted in the other part of the casing box.

The impact detector typically comprises a screw wherein one end is linked to a ribbon-parachute and the other carries the main firing pin. The screw is aligned along the longitudinal axis of the munition and is screwed through a nut that is movable through inertia in a bore hole in the casing box. When the slide is in the safety position, the main firing pin does not lie on the axis of the priming system, but it is often used to lock the slide in the safety position.

Under normal use, e.g., after the munition has been ejected from the cargo shell, the ribbon parachute is deployed to stabilize the trajectory and direct the orientation of the munition as it falls to the ground. The deployment of its ribbon-parachute, combined with the munition's rotation about the longitudinal axis (which is imparted because of the rifling in the barrel), causes a relative displacement of the impact detector screw with respect to the nut in a direction tending to separate the slide from the firing pin.

The slide thereby moves into the armed position, and the firing pin is once again aligned axially with the priming system. As the munition hits the ground, it becomes subjected to a strong deceleration, and the screw-nut assembly moves by inertia in the direction of the slide, and as a result the axial percussion of the priming system is effected by the firing pin (integrally formed with the screw) thereby causing the munition to explode instantaneously.

Generally, the impact detector functions more effectively if it is aligned with the longitudinal axis of the munition. In other words, if the trajectory of the munition at the moment of its impact with the ground corresponds roughly to this axis, there is a great probability that the system will function instantaneously.

In real terms, these optimum conditions are not always fulfilled, often due to the misfunctioning of the ribbon-parachute. If the trajectory of the munition is not correctly stabilized as it falls, it may hit the ground in a direction that hampers the correct functioning of the firing pin. Even if the munition does not detonate instantaneously, it is still dangerous.

To reduce this type of misfunctioning as the munition hits the ground, it is known to add a second function mode to the priming system that operates by self-destruction and enables the munition to be neutralized on the ground. This second function is generally operated by a delay pyrotechnic train initiated by a secondary firing pin.

In U.S. Pat. No. 4,811,664, the secondary firing pin is of the centrifugal type. It performs a pivotal movement under the effect of the rotation of the munition. Once the slide valve has moved into its armed position, a pyrotechnic delay period begins to run. The delay is calculated to be greater than the time taken by the munition to reach the ground. Once the delay period terminates, the priming system is initiated.

The solutions which use a pyrotechnic delay are nevertheless costly, and an object of the invention is to design a purely mechanical self-destruct system comprising a minimum number of elements that is also reliable and easy to implement.

SUMMARY OF THE INVENTION

Therefore, an object of the invention is to provide a priming and self-destruct system of a munition and in particular, a sub-munition having its own rotational movement around an axis designed to be ejected from a cargo shell. The invention comprises a priming system carried by a mobile slide valve from a safety position to an armed position, a main firing pin to initiate the priming system and a secondary self-destruct firing pin armed by a spring. The self-destruct part includes:

- a centrifugal trigger mounted pivotably on an axis approximately parallel to the rotational axis of the munition, a trigger that moves in response to the centrifugal force against the action of a return spring,
- a device to keep the secondary firing pin with its own spring in an armed position, the device being controlled by the trigger when the system is rotating around the axis of the munition, and
- a device which is released by the trigger when the rotational movement of the munition stops, for example after impact of the munition on the ground, and when the trigger changes position after spring-back of its return spring,
- the secondary firing pin thereby causing the radial percussion of the priming system through an opening in the slide valve.

Therefore, the self-destruct part of the system according to the invention is activated when the munition is no longer subject to a rotational movement, in other words, after its impact with the ground. It functions almost instantaneously, whereas in prior systems, the pyrotechnic delay is initiated as the munition falls and after the slide has moved into its armed position, and, consequently, its functioning is delayed for a certain time after the munition hits the ground.

The use of a secondary firing pin to ensure the radial percussion of the priming system increases the reliability of the self-destruct system (the object of which is to correct a failure on the part of the main firing pin). The system is also both simpler and more reliable because it does not use a pyrotechnic delay.

According to one particular embodiment, the retention device is a catch finger integrally formed with the trigger and set at one end of the latter, the catch finger operating with a circular groove cut in a part of the secondary firing pin in such a way as to keep the firing pin and its spring in the armed position when the trigger return spring is compressed and to release the firing pin when the trigger, under the action of its return spring, has moved to the firing position.

Therefore, when the slide valve has moved into the armed position as the munition falls to the ground, the secondary firing pin remains in an armed position as it is blocked by the lock finger of the centrifugal detector.

This finger retracts after the munition hits the ground so as to release the secondary firing pin.

In a preferred embodiment, the system is structured to retain the secondary firing pin with its spring in the armed position when the slide valve is in the safety position. The advantage of such an arrangement is to make it possible to control the energy available for self-destruction. In fact, this energy is supplied by a spring that is retained in a compressed position during storage and during the arming phase.

In one particular embodiment, when the system is in the safety position, the secondary firing pin is maintained in the armed position by the slide by which it is supported.

According to another embodiment, when the system is in the safety position, the secondary firing pin is retained in its armed position by the trigger finger, the latter being retained by the slide valve in such a position that it compresses its own return spring. Such an arrangement avoids the risk of the slide valve becoming blocked because of the secondary firing pin is pressing on it.

According to one variant, the slide valve is a slide moving in translation from its safety position to its armed position, and which is fitted with a dog point which supports the trigger when the slide valve is in the safety position. The trigger pushing on the dog point enables the secondary firing pin to be kept in an armed position by the catch finger without the firing pin being supported by the slide.

In another variant, the trigger is fitted with a notch designed to accommodate a protecting stop movement device on a side face of the slide, after impact of the munition on the ground, to prevent the slide from moving into its armed position. In the event of a misfunction, such as that resulting from the slide not moving into its armed position before impact of the munition on the ground, this automatically leads to the non-functioning of the priming and self-destruct system. In this case, the munition on the ground still remains dangerous. Indeed, the slide could possibly move into its armed position after being accidentally jolted and thereby cause the munition to function.

Also, according to another characteristic of the invention, the moving element of the centrifugal detector comprises a blocking device to prevent the slide valve from moving into the armed position after the munition hits the ground.

According to another characteristic of the invention, the slide is made in the form of a shutter mounted to rotate about an axis parallel to the axis of the munition, and the shutter is fitted with a lip which supports the end of the trigger. The end of the trigger can feature a lock which prevents the flap from rotating.

In accordance with a preferred embodiment, the secondary firing pin is constituted by a hollow part closed off at one end by a bottom wall elongated on the outside by a percussion tip and closed off at the other end by a disk fixed to the casing box, the arming spring of the secondary firing pin being housed inside the hollow part.

The secondary firing pin can be integrally formed with the trigger, wherein the secondary firing pin spring is the trigger return spring. This particular embodiment has the advantage of being very simple because only a few component parts are needed.

In general terms, the priming and self-destruct system is mounted in a casing box surmounting the body of the munition which encloses the war charge, the slide which supports the priming system having a first face adjacent the war charge and a second opposite face adjacent the impact detector. According to another characteristic of the invention, the secondary firing pin and the centrifugal detector are mounted outside the slide and next to one of its side faces, the latter having the opening through which the secondary firing pin can initiate the priming system. The secondary firing pin and the slide should be roughly coplanar, the secondary firing pin being movable in translation following an inclined axis with respect to the axis of movement of the slide.

According to yet another advantage of the invention, the secondary firing pin may function irrespective of the trajectory of the munition when it impacts with the ground.

BRIEF DESCRIPTION OF THE DRAWINGS

Other advantages, characteristics and details of the invention will be revealed by the explanatory description which will follow, this description is made with reference to the annexed drawings which are given only as an example and in which.

DETAILED DESCRIPTION OF PREFERRED EMBODIMENTS

Figure 1:
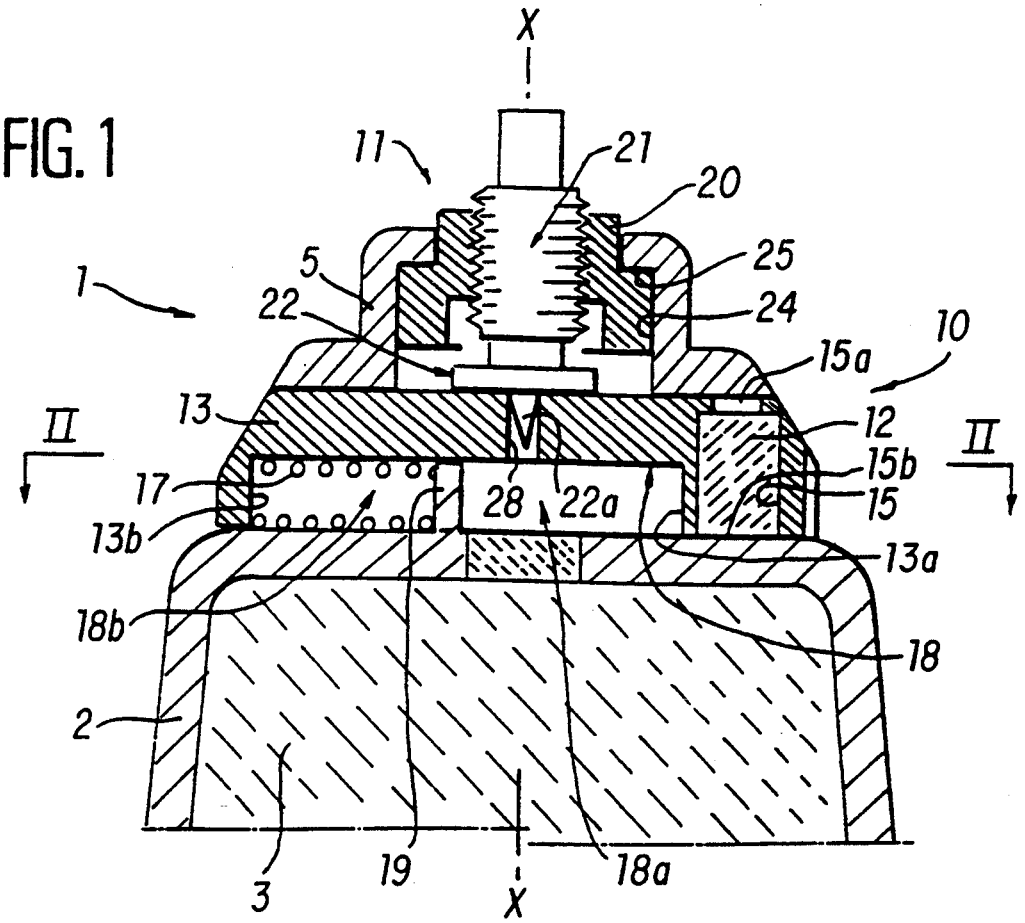
FIG. 1 is a partial longitudinal cross section of a priming and self-destruct system of a munition according to the invention.
Figure 2:
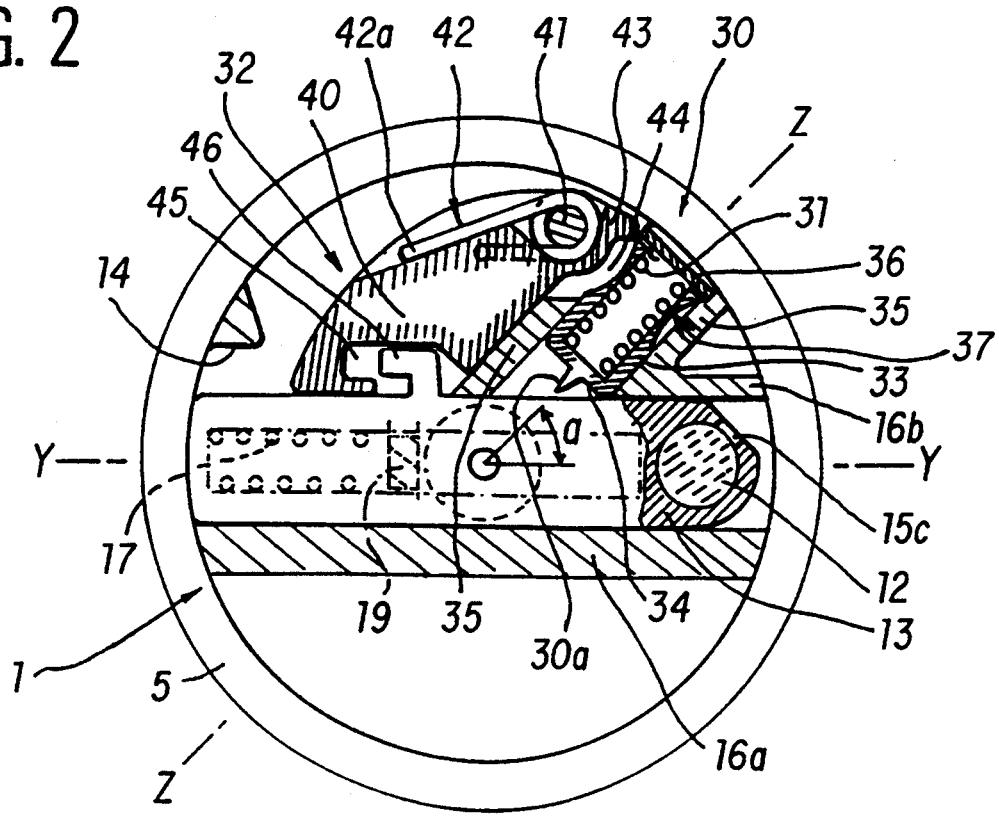
FIG. 2 is a cross section following the axis II—II of FIG. 1, with the slide which supports the priming means of the munition shown in its safety position.

The munition 1, as shown in FIGS. 1 and 2 according to a first embodiment of the invention, comprises a body 2 of a generally cylindrical shape which surrounds a war charge 3. Toward one end, the body 2 is attached to a casing box 5 that houses the priming and self-destruct system of the munition 1.

The priming part of the system comprises a pyrotechnic train 10 housed in the part of the casing box 5 that is adjacent to the war charge 3 and an inertial impact detector 11 housed in the part of the casing box 5 that is opposite the war charge 3.

Figure 3:
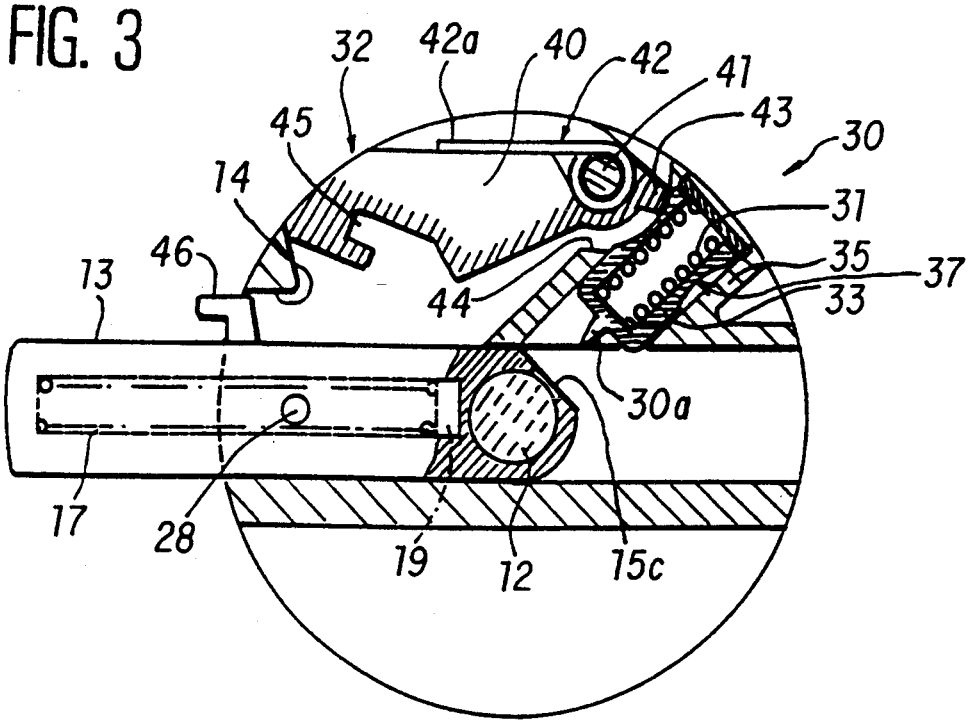
FIG. 3 is a similar view to that of FIG. 2, but with the slide shown in its armed position.
Figure 4:
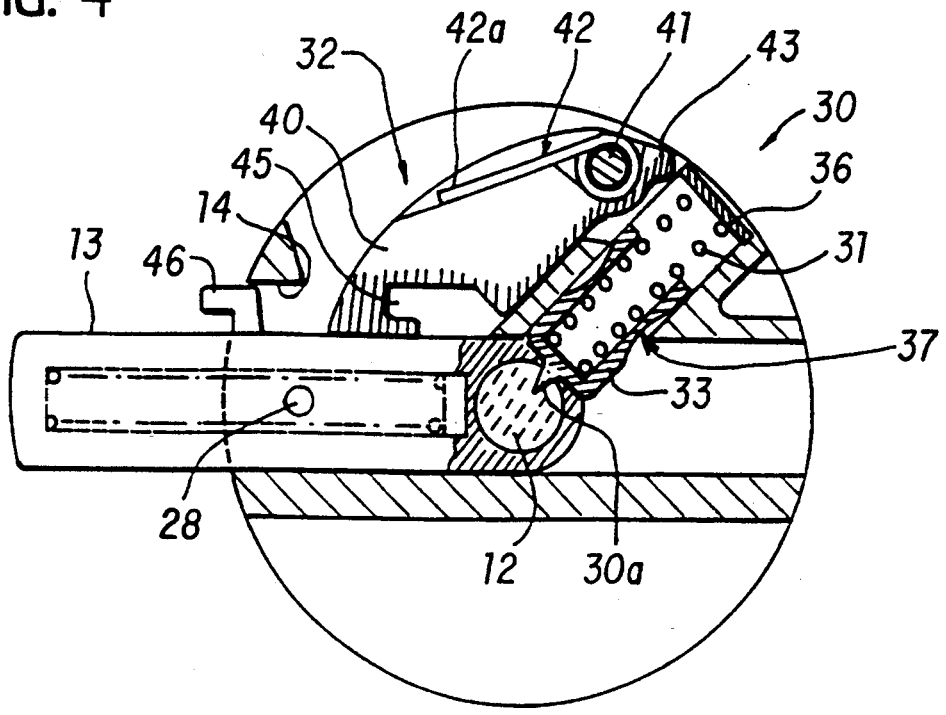
FIG. 4 is a similar view to that of FIG. 3, after the self-destruct part of the system has been activated.

The pyrotechnic train 10 comprises priming means 12, such as a primer, carried by a slide valve 13 in the form of a slide moving in translation from a safety position (FIG. 1) to an armed position (FIG. 3) wherein it projects partially from the casing box by means of an opening 14.

Toward one end, hereinafter the back end, the slide 13 includes a cavity 15 which houses the priming means 12. This cavity 15 opens to the outside by means of an upper opening 15*a* situated on the face of the slide 13 adjacent the impact detector 11. The cavity 15 also opens to the outside by means of an opposite lower opening 15*b* situated on the face of the slide 13 adjacent the war charge 3 and which is blocked for example, by means of a mat (not shown). The cavity is also open at the back part of the slide 13, by means of an opening 15*c* (FIG. 2) in a side face of the slide.

The slide 13 is mounted between two parallel side walls 16*a* and 16*b* of the casing box 5, and its translational movement along an axis Y—Y from its safety position to its armed position is guided by means of a spring 17.

In particular with respect to this first embodiment, the lower face of the slide 13, adjacent the war charge 3, is fitted with a longitudinal recess 18 between two bottom walls 13*a* and 13*b*, the wall 13*a* being adjacent the cavity 15 which houses the priming means 12. A central fixed stop 19, integrally formed with the body 2 of the munition 1, projects from this recess 18.

When the slide 13 is in the safety position, the stop 19 splits this recess into two parts 18*a* and 18*b*. The first part 18*a* extends over a length that corresponds to the necessary distance for moving the slide 13 to the armed position; the second part 18*b* accommodates the spring 17 while it is under tension.

The impact detector 11 comprises a mobile assembly that includes a nut 20, a screw 21 and a main firing pin 22. More precisely, the nut is mounted in a bore 24 in the casing box 5 aligned axially with the rotational axis X—X of the munition 1; this bore 24 opens into the outside of the casing box 5. The nut 20 is retained in the bore 24 of the casing box 5 by means of a collar 24 resulting from a reduction in diameter of the nut 20 and which operates with a complementing collar resulting from a reduction in the diameter of the bore hole 24.

The screw 21 is axially aligned along the axis X—X and is screwed through the nut 20, leaving one end projecting slightly above the casing box 5 while the other end supports the main firing pin 22. The firing pin 22 is tipped with a percussion tip 22*a*.

When the slide 13 is in its safety position (FIG. 1), the tip 22*a* of the firing pin 22 is engaged in an orifice 28 of the slide 13 such that the pin 22 is kept in the safety position.

As shown in FIG. 2, the self-destruct part of the system comprises a secondary firing pin 30 armed by a spring 31 and a centrifugal detector 32. The secondary firing pin 30 comprises a cavity closed at one end by a bottom wall 34, out of which projects a percussion tip 30*a*. The secondary firing pin 30 moves in translation inside a housing 35 of the casing box 5. This housing 35 is open at both ends. The first opening projects through the wall 16*b* of the housing 35 of the slide 13 in such a way that the translational movement of the secondary firing pin 30 occurs along an axis Z—Z which is offset at an angle of approximately 30° with respect to the axis of movement Y—Y of the slide 13.

The arming spring 31 of the secondary firing pin is mounted in the cavity 33, and it is supported on the opposite side from the percussion tip 30*a* by a closing plate 36 that is integrally formed with the casing box 5. When the slide 13 is in its safety position, the hollow part 33 of the secondary firing pin 30 is supported by its bottom wall 34 on the side face of the slide 13, which enables the secondary firing pin 30 to be kept in its armed position with its arming spring 31 in a tensed position.

The centrifugal detector 32 comprises a mobile element or centrifugal trigger 40 which is pivotably mounted around an axis 41 that lies parallel to the independent rotational axis X—X of the munition 1. The trigger 40 operates under the force of a spring 42 that is partly rolled around the axis 41. One end of the spring 42 is anchored in the casing box 5 and the other end 42*a* urges the trigger 40 to keep it pushed against the slide 13.

Toward one end, the trigger 40 is fitted with a catch finger 43 which is designed to project from an opening 44 inside the housing 35 to come to rest against a circular groove 37 fitted in the hollow part 33 of the secondary firing pin 30. This catch finger 43 constitutes a means to retain the secondary firing pin 30 in its armed position when the priming system is following a rotational movement around the axis X—X of the munition. Therefore, it enables the secondary firing pin to be maintained in the armed position when the slide 13 has moved into the armed position.

Toward its other end, the trigger 40 is fitted with a notch 45 that is dimensioned to accommodate a stop 46 projecting from a side face of the slide 13 adjacent the trigger 40, in circumstances which will be explained later.

The functioning of the self-destruct and priming system according to the first embodiment will now be described with reference to FIGS. 1 to 5.

Before the munition 1 is ejected from the cargo shell, the priming system and self-destruct system is in the position as shown in FIGS. 1 and 2. In other words: the slide 13 is in its safety position with its arming spring 17 in a tensed position, it is maintained in this position by the main firing pin 22 which penetrates, by its percussion tip 22*a*, in the orifice 28 of the slide 13; the secondary firing pin 30 is retained in the armed position by means of its tensed spring 31, pushing by means of its bottom wall 34 against the slide 13; and the trigger 40 occupies a first position (i.e., the "central position") wherein it exercises no action on the secondary firing pin 30, its corresponding spring 42 exercising a slight force which only serves to keep the trigger pushed against the slide 13.

After being ejected, the munition moves rotationally around its longitudinal axis X—X, the resulting centrifugal forces cause the trigger 40 of the centrifugal detector 32 to pivot around its axis 41. The trigger 40 thereby moves away from the slide 13 (i.e., toward the "outer position") by compressing the spring 42.

As a result of the pivoting movement of the trigger 40, its catch finger 43 projects from the opening 44 inside the housing 35, it penetrates in the groove 37 and thereby maintains the secondary firing pin 30 in the armed position.

The secondary firing pin 30 is maintained in this position for as long as the munition 1 is revolving around its own axis X—X, i.e., until the munition reaches the ground.

At the same time, after the munition 1 has been ejected, a ribbon-parachute (not shown) connected to the screw 21 of the impact detector 11 is deployed to stabilize the munition 1 during its fall. This deployment combined with the rotational movement of the munition 1, causes the screw 21 to become unscrewed from its support nut 20, which causes thereafter the translational movement of the main firing pin 22 which moves it away from the slide 13 and releases the percussion tip 22*a* from the orifice 28 of the slide 13.

In these circumstances, the arming spring 17 springs back, and the slide 13 moves toward the armed position, i.e., once the bottom wall 13*a* of the recess 18 of the slide 13 has entered into contact with the fixed stop 19. As a result of the movement of the slide 13, the secondary firing pin 30 is no longer pushed against the slide 13, but it is nevertheless retained in the armed position by means of the catch finger 43 of the trigger 40 of the centrifugal detector 32. When the slide is in its armed position, the side opening 15*c* of the housing 15 which encloses the priming means 12 is axially aligned with the percussion tip 30a of the secondary firing pin 30.

Under normal functioning, the impact of the 15 munition 1 on the ground creates a strong deceleration which causes the assembly of the screw 21, the nut 20, and the main firing pin 22 to move towards the slide 13. If the assembly has moved into its armed position, the main firing pin 22 is axially aligned with the priming means 12 and can be initiated by percussion to cause the instantaneous functioning of the munition 1.

In the event that the priming part of the system misfunctions at the moment of impact of the munition 1 on the ground (i.e., when the main firing pin 22 does not initiate the priming means 12), the initiation of the munition is nevertheless ensured by the self-destruct part of the system. In fact, after the rotational movement of the munition 1 has stopped after its impact on the ground, the trigger 40 of the centrifugal detector 32 is brought back to its first position as its corresponding return spring 42 springs back. In these circumstances, the catch finger 43 of the trigger 40 is disengaged from the opening 44 and thereby 35 releases the secondary firing pin 30 which, as a result of its arming spring 31 springing back, radially strikes the priming means 12 with its tip 30*a* through the opening 15*c* of the slide 13 (see FIG. 4).

To enable the secondary firing pin 30 to initiate the priming means by a radial or axial impact, the layer covering the priming means must be sufficiently thin in the area of opening 15*c*. Several thin metal sheets (or flaps), for example, can be placed within the cavity 15 to cover the opening 15*c*.

Figure 1A:
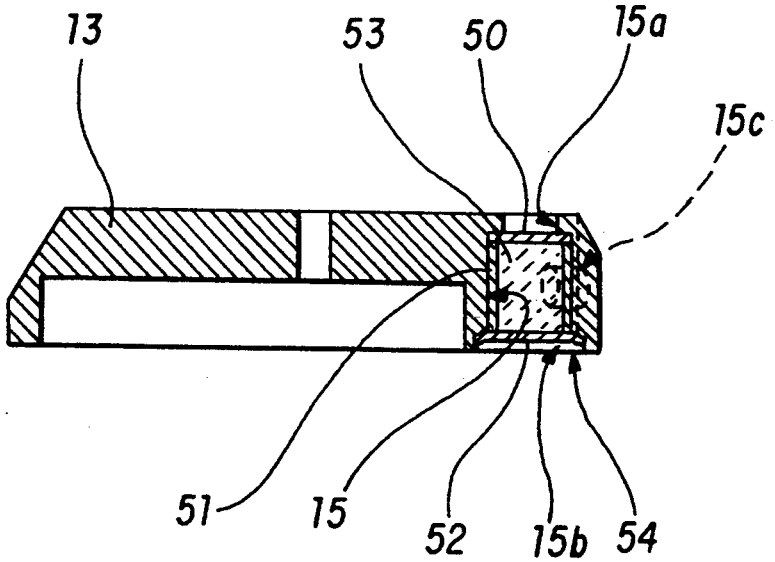
FIG. 1*a* is a detailed view of the slide on its own.

FIG. 1*a* is a detailed view of the slide showing an example of such a priming means. The cavity 15 accommodates an upper flap 50 which closes the opening 15*a*, a cylindrical side flap 51 which blocks the 15 opening 15*c*, and a closing flap 52 blocking the opening in the cavity 15*b*.

The composition 53 will be put in place by means of compression while the slide valve is equipped with upper flaps 50 and side flaps 51. The closing flap 52 is added later and maintained, for example, by the circular crimping 54 of the opening 15*b* of the slide valve 15. The opening 15*b* of the slide valve is countersunk to enable crimping and to prevent the finished crimping from interfering with free movement of the slide. The initiation of the priming means 12 causes the war charge 3 to detonate, and the munition 1 to become neutralized.

In the event that the slide 13 has not moved into its armed position during the fall and impact of the munition 1 on the ground, the priming and self-destruct system is inoperative. In fact, the main firing pin 22 is 35 not aligned axially with the priming means 12, and the secondary firing pin 30 is not aligned axially with the opening 15*c* of the slide 13.

Figure 5:
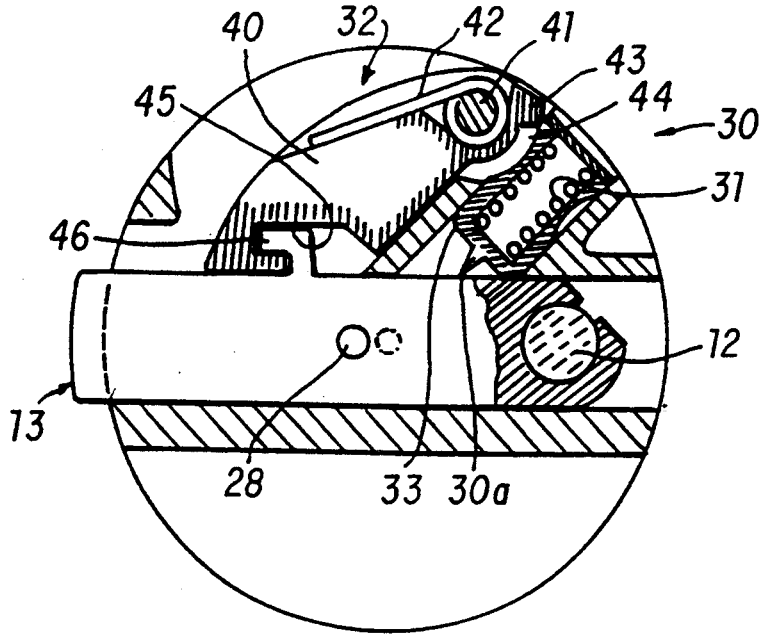
FIG. 5 is a view similar to that of FIG. 2, after the slide has been blocked by the self-destruct part of the system when the slide has not been moved into the armed position.

In order to avoid the accidental initiation of the munition 1 during handling when the slide 13 is moved into the armed position, a notch 45 is fitted on the trigger 40 toward the opposite end of that of the catch finger 43. When the trigger 40 of the centrifugal detector 32 is in its first position (i.e., the munition 1 is no longer in rotation), the notch 45 is situated opposite the side stop 46 of the slide 13. In these circumstances, if the slide 13 moves toward its armed position, following an accidental jolt, its stop 46 will automatically be accommodated by the notch 45 of the trigger 40 which will prevent the slide 13 from becoming armed (FIG. 5).

Figure 6:
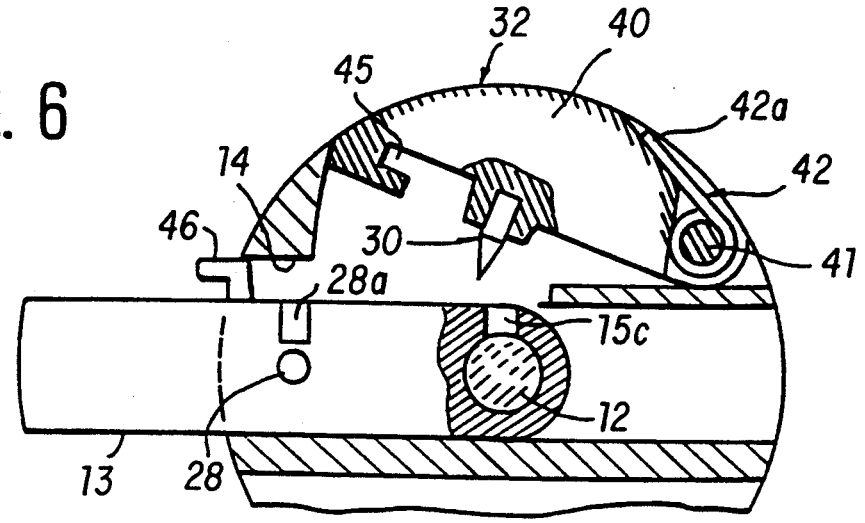
FIG. 6 is a view similar to that of FIG. 3, to illustrate a second embodiment of the invention, the slide being shown in the armed position.
Figure 7:
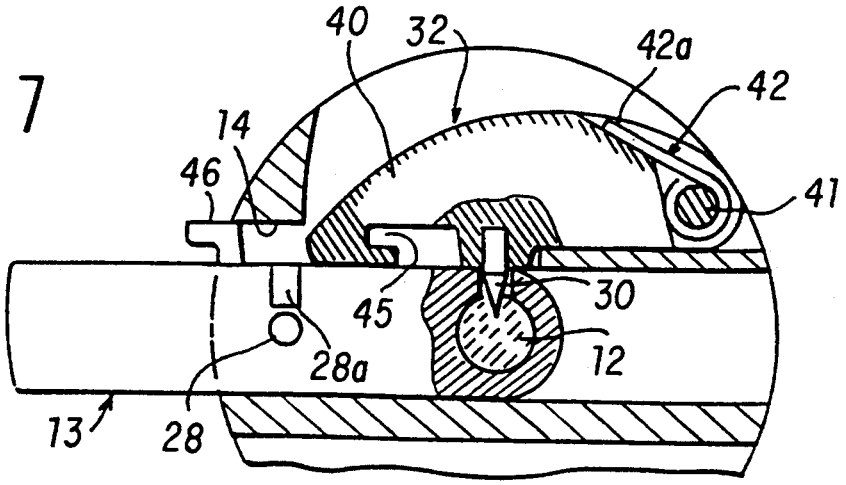
FIG. 7 is a view similar to that of FIG. 6, after the self-destruct part of the system has been activated according to the invention.

A second embodiment of the self-destruct part is illustrated by FIGS. 6 and 7. In this particular embodiment, the secondary firing pin 30 is integrally formed with the trigger 40 of the centrifugal detector 32.

In this case, after the munition 1 has been ejected and the ribbon-parachute deployed, the priming and self-destruct system is in the position as shown in FIG. 6. The trigger 40 of the centrifugal detector 32 has moved from its first to its second position away from the slide 13, and the corresponding spring 42 is under tension.

After the slide 13 has moved into the armed position and in the event of a misfunctioning of the main firing pin 22 at the moment of impact of the munition 1 on the ground, the trigger 40 of the centrifugal detector 32 30 moves from its second to its first position as the spring 42 springs back after the munition 1 stops its rotation.

The secondary firing pin 30, which moves with the trigger 40, radially strikes the priming means 12 through the opening 15*c* of the slide 13.

In this second embodiment, the arming spring of the secondary firing pin 30 is constituted by the spring 42 which brings the trigger 40 of the centrifugal detector 32 back from its second to its first position.

When the slide 13 is in its safety position and the trigger 40 is in its first position in the absence of any rotational movement of the munition 1, the secondary firing pin 30 slips into an orifice 28*a* cut into the side face of the slide 13 situated opposite the trigger. The secondary firing pin thereby acts as a supplementary lock for the slide and increases the safety of the priming system.

As a variant in this second embodiment, the secondary firing pin 30 could replace the means 45 and 46 of the first embodiment to avoid the slide 13 moving into the armed position after impact of the munition on the ground.

Figure 8:
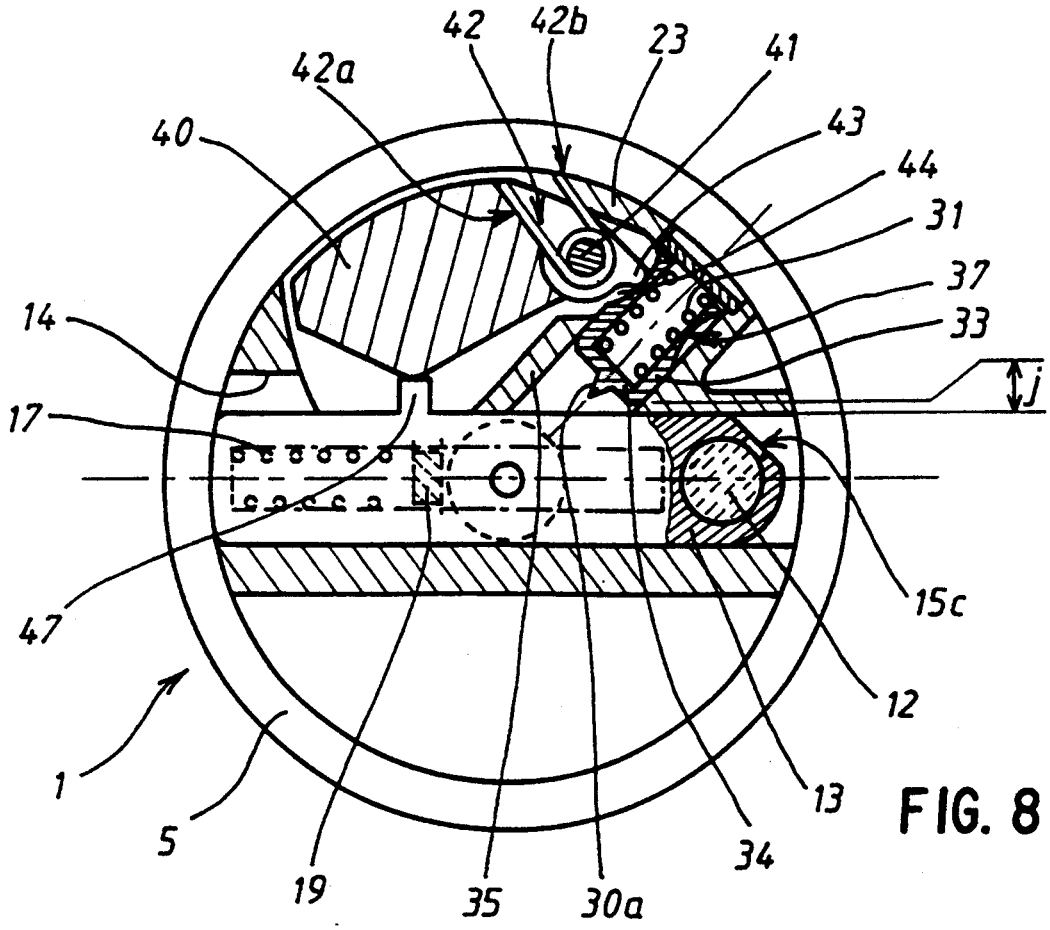
FIG. 8 is a cross section following the plane II—II of FIG. 1, of a munition according to a third embodiment of the invention, the slide being shown in its safety position.
Figure 9:
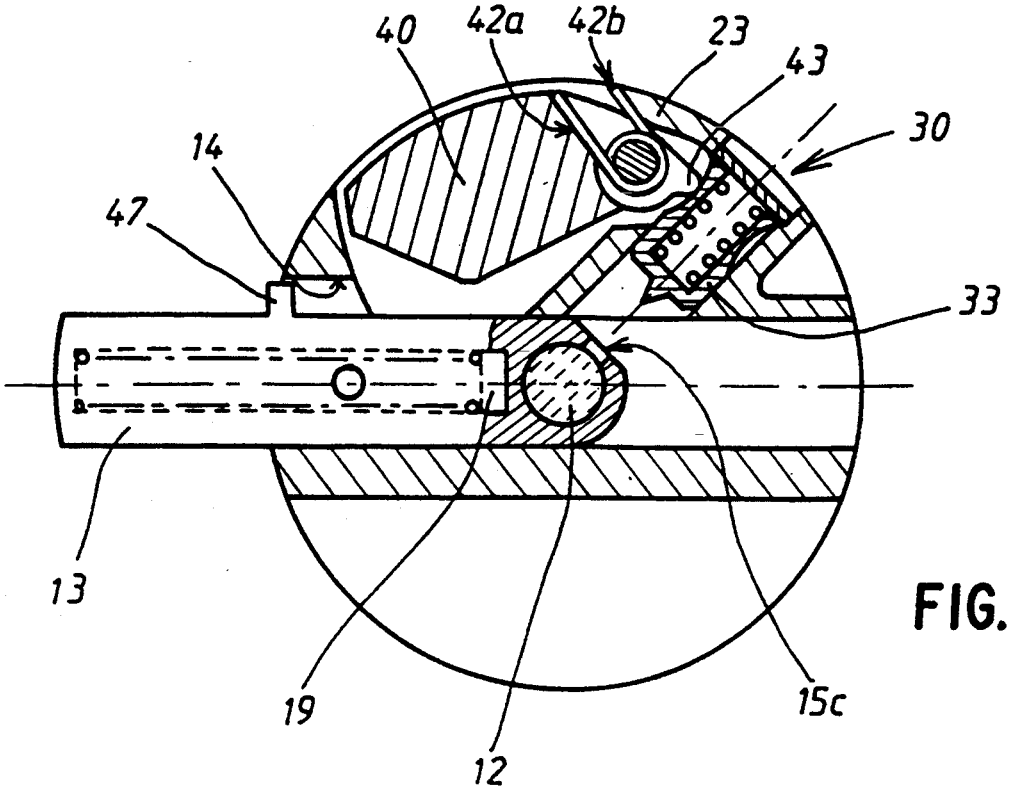
FIG. 9 is a view similar to that of FIG. 8, the slide being shown in its armed position.
Figure 10:
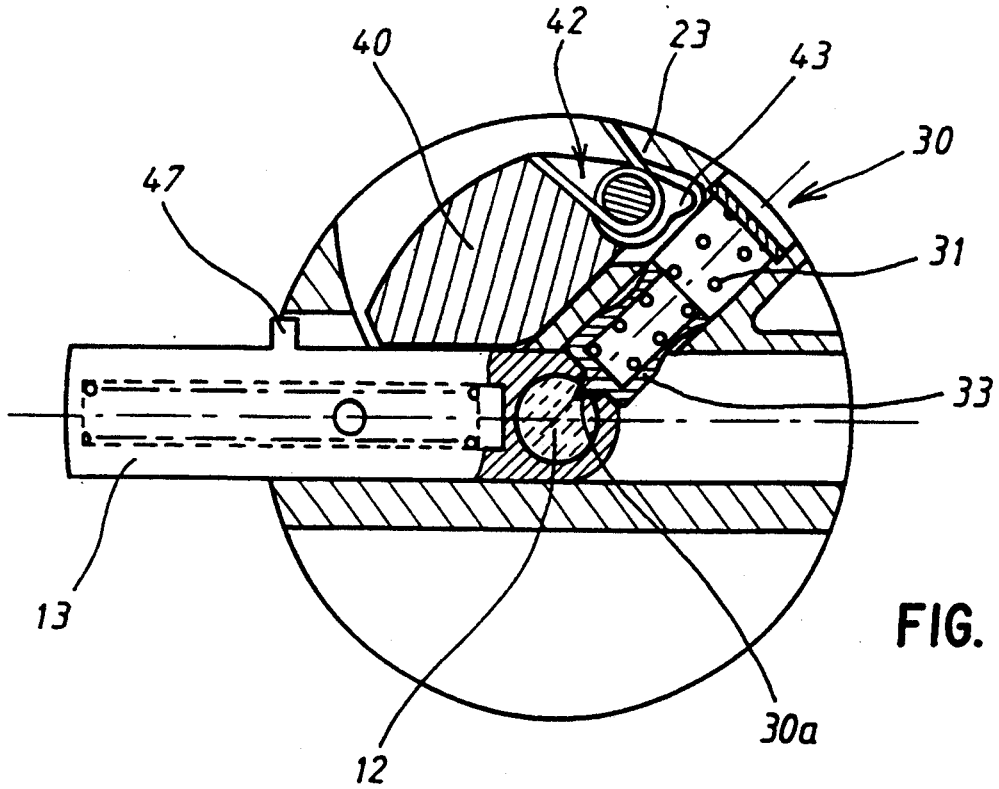
FIG. 10 is a view similar to that of FIG. 8, after the self-destruct part of the system has been activated.

A third embodiment is represented in FIGS. 8, 9 and 10. In this particular embodiment, the priming system is still represented as a cross section following the line II—II in FIG. 1. FIG. 1 is a representation which is common to both this embodiment and the first embodiment described with reference to FIGS. 1 to 5. This third embodiment only differs from the first in terms of the self-destruct part.

FIG. 8 depicts the priming system in the safety position, showing that the trigger 40 also comprises a catch finger 43 which projects in the opening 44 fitted in the body 5. The catch finger 43 presses against the part 33 of the secondary firing pin within a circular groove 37 thereof. In this embodiment, the trigger 40 retains the secondary firing pin with its spring 31 is under tension when the priming system is in the safety position.

The bottom wall 34 is not pressing against the slide 13, and there is some gap j between these two elements. The trigger spring 42 is also in a compressed position; with one end 42*a* it presses against the trigger and with the other end 42*b* against a rim 23 of the body 5. The trigger is retained in this position by a dog point 47 integral with the slide 13.

The advantage of such an arrangement is that it enables any risk of the slide 13 being blocked by the part 33 of the secondary firing pin 30 to be avoided. The reliability of the system also increases.

FIG. 9 represents the same system when the slide 13 is in the armed position. The munition has a rotational movement which maintains the trigger 40 in the position wherein it acts as a lock to the secondary firing pin 30 while the springs 42 and 31 are under tension. As described above, the screw 21 is unscrewed by the action of the ribbon-parachute. The main firing pin has moved aside and has released the slide 13 which has adopted its armed position.

FIG. 10 shows the priming system upon impact with the ground. The trigger 40 is released when the munition stops rotating, and under the action of the spring 42, the trigger comes to stop against the casing box 5. The catch finger 43 is thereby disengaged from the opening 44 and releases the secondary firing pin 30. The secondary firing pin 30, under the action of spring 31, radially strikes the priming means 12 through the opening 15*c* of the slide.

With this particular embodiment, the trigger 40 is simply pressing against the dog point 47 of the slide 13. Therefore, it does not prevent the slide from moving freely into the armed position by means of the spring 17. It should be noted that, in the case of a munition delivered by means of an artillery cargo shell, the munition has a rotational movement that is imparted by the rotation of the shell before the munition separates from it.

The trigger 40 moves slightly away from the slide before the munition is scattered, and therefore also before the slide has been freed by the main firing pin. In this way it does not prevent the slide from moving freely into its armed position.

Figure 11:
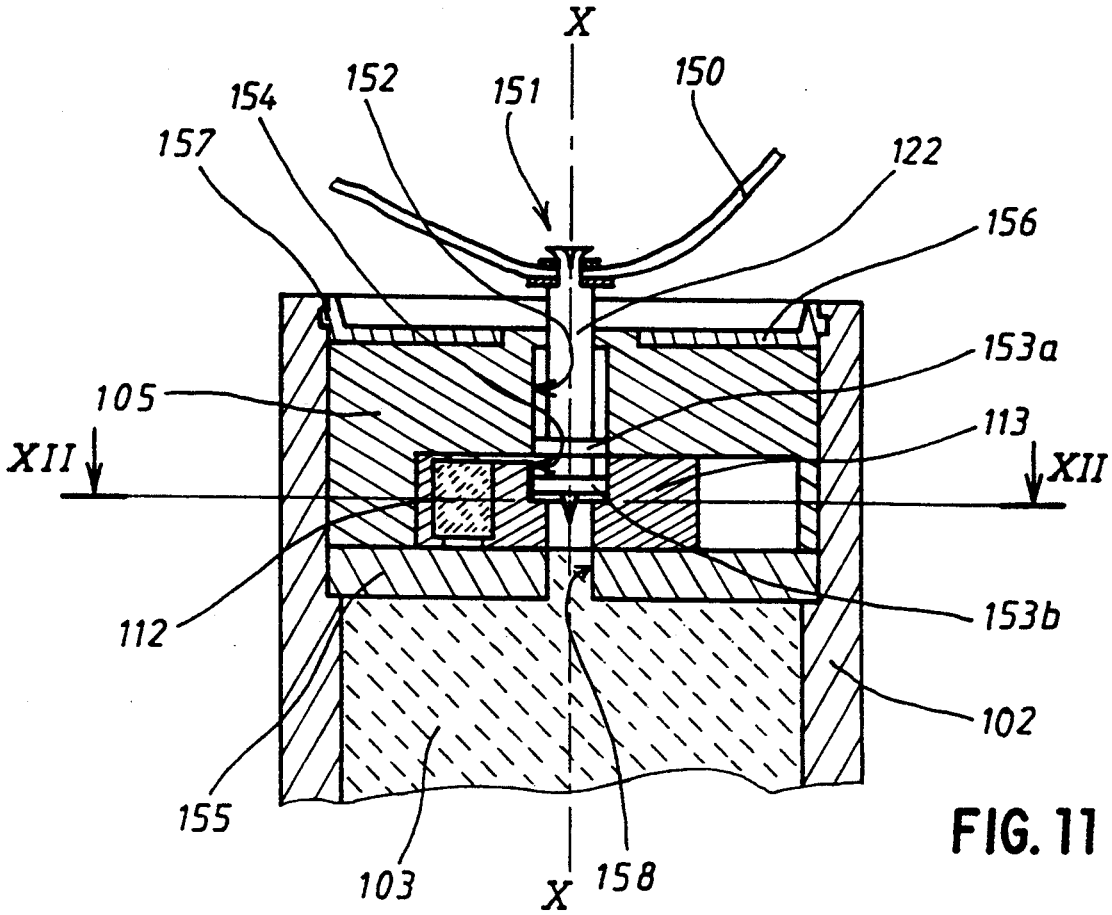
FIG. 11 is a partial longitudinal cross section of a priming and self-destruct system for a munition, according to a fourth embodiment of the invention, the cross section follows the broken plane XI—XI whose axis is drawn in FIG. 12.
Figure 12:
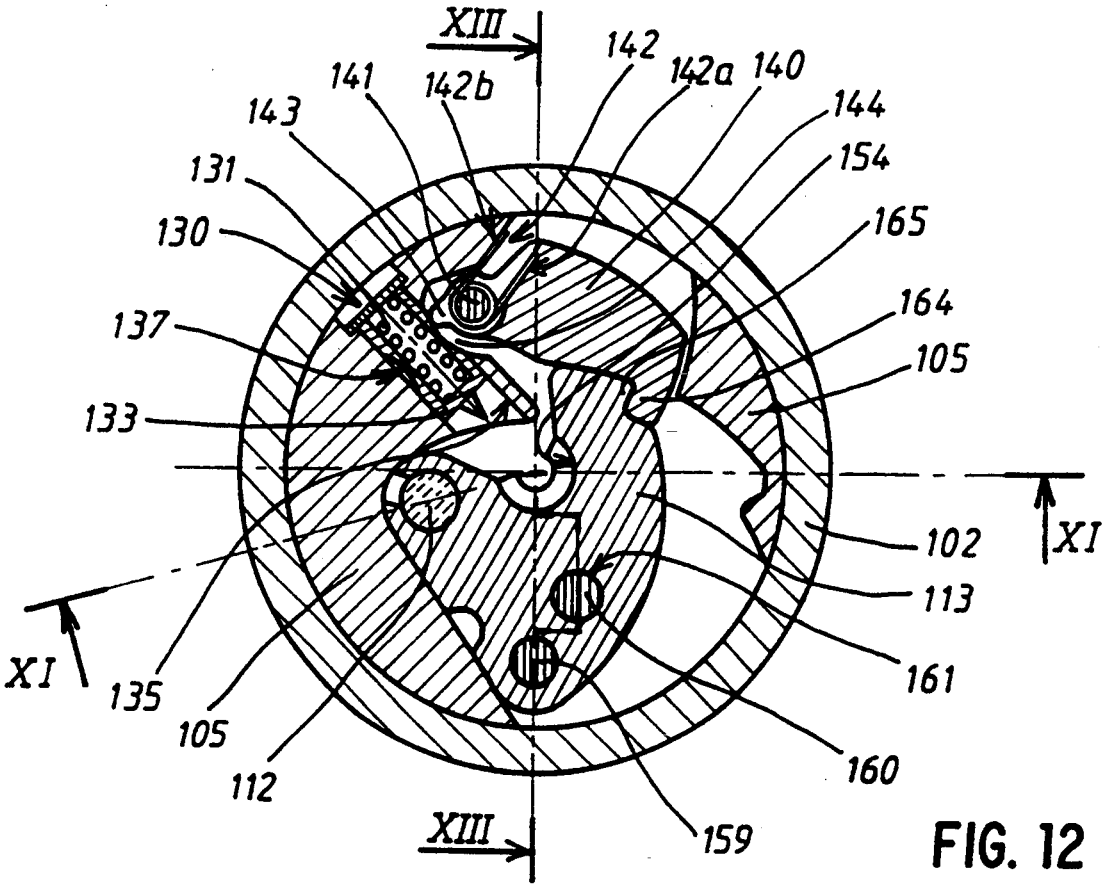
FIG. 12 is a cross section following the plane XII—XII as drawn on FIG. 11, the shutter being shown in its safety position.
Figure 13:
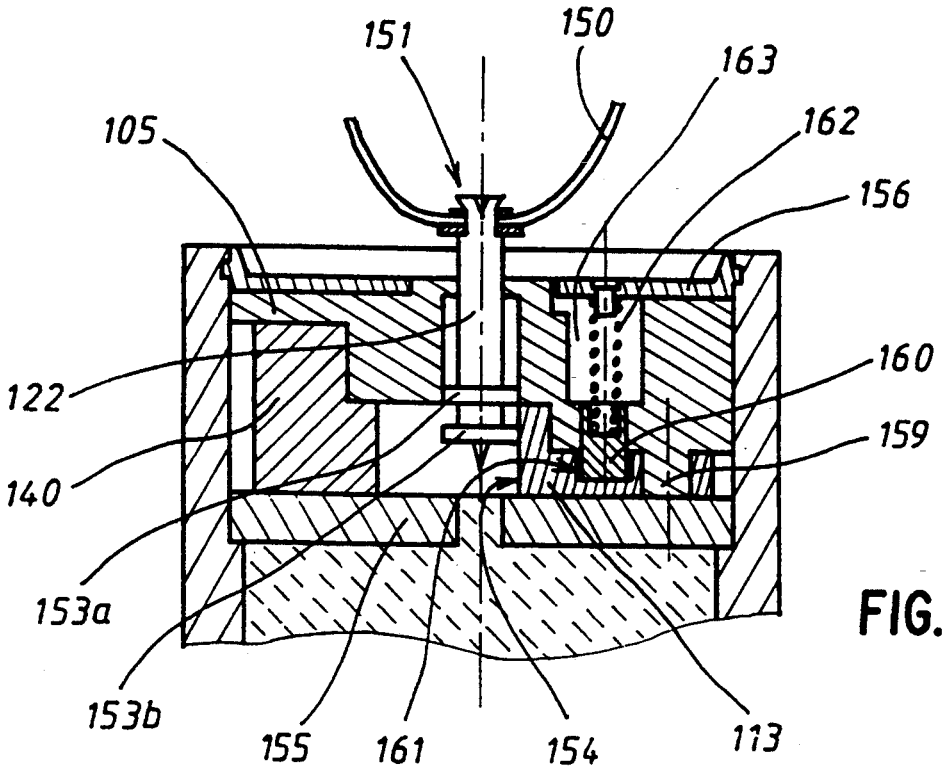
FIG. 13 is a cross section following the parallel planes XIII—XIII whose axis is drawn on FIG. 12.

FIGS. 11 through 15 represent a fourth embodiment, wherein the slide valve is constituted of a rotating shutter 113 that holds a primer 112. FIGS. 11, 12 and 13 represent the system in its safety position. The priming system is enclosed in the body 102 of the munition. It is kept in contact on a bottom plate 155 by means of a lid 156 that is made of sheet metal. The lid is integrally formed with the body 102 by means of a circular rim 157. The circular rim 157 is crimped into a corresponding groove in the body 102. The bottom 155 has an axial orifice 158 designed to enable the war charge 103 to be primed by means of the primer 112 integral with the shutter 113.

FIG. 11 depicts the main firing pin 122 carrying a ribbon-parachute 150 on its back part made integral with the firing pin by crimping 151. The firing pin 122 is slidably mounted in a bore hole 152 within a casing box 105. A front part of the main firing pin 122 is fitted with two flanges 153*a* and 153*b* having the same diameter. Flange 153*a* is set in the bore hole 152, flange 153*b* is set in a bore hole 154 of the shutter 113 and constitutes a lock which prevents the shutter 113 from moving into the armed position.

FIG. 12 shows the shape of the shutter 113 in greater detail. It is mounted rotatably on an axis 159 integral with the casing box 105 and parallel to the axis X—X of the munition (see also FIG. 13). The shutter is immobilized in its safety position (FIG. 12) by means of three locks. A first lock is the flange 153*b* of the firing pin (not represented in this Figure but set into the bore hole 154). A second lock is an inertia lock comprising a sink head 160 engaged in a hole 161 in the shutter 113. The sink head is retained in this position by a spring 162 which presses against the lid 156 (see FIG. 13).

The sink head is designed to give way against the action of its spring when the shell carrying this munition is fired. When the initial firing acceleration of the shell reduces, the sink head is trapped in the space 163 which surrounds the spring 162 and does not recover its place in the hole 161 of the shutter. The sink head remains trapped because it is subject to a centrifugal acceleration which pushes it against the walls of the space 163 and prevents it from returning to its safety position. Such an inertia lock is described in detail in U.S. Pat. No. 5,206,457.

A third lock is an end 164 of a centrifugal trigger 140 mounted rotatably around an axis 141 parallel to the rotational axis X—X of the munition. The shutter 113 is fitted with a lip 165 which comes into contact with the end 164 of the trigger 140. In the safety position represented in FIG. 12, the trigger 140 is urged against the shutter 113 by the spring 142. The spring 142 is partly rolled around the axis 141; by one end 142*a* it rests on the trigger 140 and by the other on the casing box 105. The trigger 140, as in the preceding embodiments, is fitted with a catch finger 143 which penetrates in a housing 135 fitted in the casing box 105 through an opening 144. The catch finger 143 presses against a part 133 of a secondary firing pin 130 in a circular groove 137 cut into the latter.

As described above, the trigger 140 retains the secondary firing pin and its spring 131 is under tension when the priming system is in the safety position.

In operation, this priming system functions according to the following process. When the cargo shell containing the munition is fired, the sink head 160 disengages from the shutter 113 through the action of inertial forces. The rotation imparted to the munition by the shell removes the trigger 140 from its locked position as represented in FIG. 12. Thereafter, the trigger moves to the position shown in FIG. 14, wherein the end 164 releases the lip 165 of the shutter 113. The shutter is still maintained in a safety position by means of the main firing pin.

When the munition separates, the ribbon-parachute is deployed and it pulls on the main firing pin. The flange 153*b* is then disengaged from the bore hole 154 of the shutter.

Figure 14:
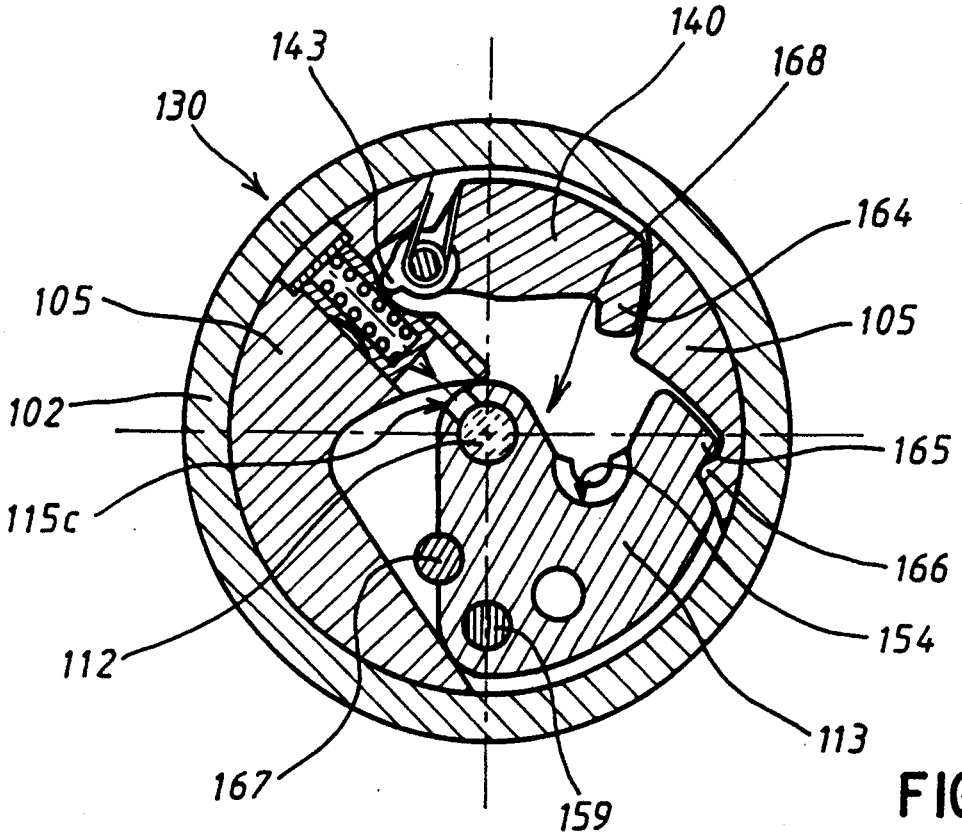
FIG. 14 is analogous to FIG. 12, the flap being shown in its armed position.
Figure 15:
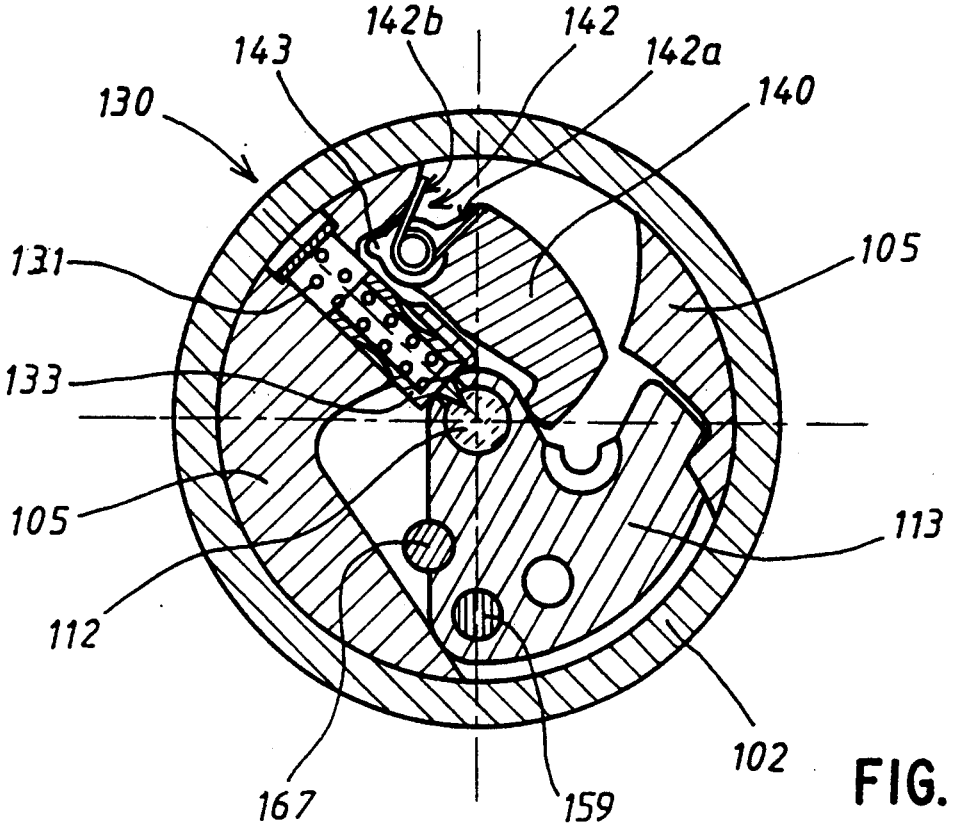
FIG. 15 is a view similar to that of FIG. 12, after the self-destruct part of the system has been activated.

The shutter 113 then adopts its armed position as represented in FIG. 14 through the effect of the centrifugal inertial forces to which it is subject. So that it can move into this position, the shutter is designed such that its center of gravity is right of the axis XIII—XIII when the shutter is in the safety position (FIG. 12). The lip 165 of the shutter 113 presses against a stop surface 166 fitted on the casing box 105. A lock 167 is provided, as is well known in the art, by a pin pushed by a spring. The pin and the spring are positioned in a housing (not shown) fitted into the bottom plate 155. The spring is kept under tension by the lower face of the shutter 113.

When the shutter 113 is in its armed position, the pin that is pushed by the spring is in a locked position (FIG. 14) that prevents the shutter from returning to its safety position.

When the munition arrives on the ground, its rotational speed decreases rapidly. The trigger 140 thereafter moves to the position shown in FIG. 15 in which, under the action of the spring 142, it butts against the shutter 113.

The catch finger 143 then disengages from the opening 144 and releases the secondary firing pin 130. The secondary firing pin 130, as urged by spring 131, radially strikes the priming means 112 through the opening 115*c* of the shutter 113. The secondary firing pin is capable of being released because the shutter is fitted with a scooped edge 168. This scooped edge 168 enables the trigger to turn at a sufficient angle for the catch finger 143 to be disengaged from the opening 144.

We claim:

1. A priming and self-destruct system for a munition comprising:

a primer carried by a movable slide valve between a safety position and an armed position;

a main firing pin to initiate the primer and a secondary self-destruct firing pin armed by a spring; and a self-destruct system comprising:

a centrifugal trigger pivotably mounted about an axis approximately parallel to the rotational axis of the munition, the centrifugal trigger being pivotable under the effect of centrifugal force against the action of a return spring, and a retainer for securing the secondary firing pin in an armed position, said retainer being controlled by the centrifugal trigger when the system is moving rotationally around the axis of the munition and being released by the centrifugal trigger when the munition stops rotating, wherein the secondary firing pin thereafter causes radial percussion of the primer through an opening of the slide valve.

2. A system according to claim 1, wherein said retainer comprises a catch finger integrally formed with the centrifugal trigger at one of its ends, the catch finger operating with a circular groove in the secondary firing pin to maintain it in the armed position when the centrifugal trigger is in an outer position and to release it when the centrifugal trigger pivots to a central position.

3. A system according to claim 2, further comprising a device that maintains the secondary firing pin in the armed position while the slide valve is in the safety position.

4. A system according to claim 3, wherein the secondary firing pin is maintained in-the armed position by the slide valve against which it presses while the slide valve is in the safety position.

5. A system according to claim 3, wherein the secondary firing pin is maintained in the armed position by a catch finger, the catch finger being secured by the slide valve such that the catch finger compresses the return spring of the centrifugal trigger.

6. A system according to claim 5, wherein the slide valve is a slide movable in translation from the safety position to the armed position and fitted with a dog point on which the centrifugal trigger presses when the slide is in the safety position.

7. A system according to claim 6, wherein the trigger is fitted with a notch designed to accommodate a stop that projects from a side face of the slide valve to prevent the slide from moving into its armed position after impact of the munition on the ground.

8. A system according to claim 5, wherein the slide valve is made in the form of a shutter rotatably mounted around an axis parallel to the axis of the munition, the shutter having a lip against which the end of the centrifugal trigger comes to rest.

9. A system according to claim 8, wherein the end of the centrifugal trigger comprises a lock to prevent the shutter from rotating.

10. A system according to claim 1, wherein the secondary firing pin is a hollow part closed at one end by a bottom wall-having a percussion tip and closed at the other end by a closing plate fixed to the munition, the spring of the secondary firing pin being housed inside the hollow part.

11. A system according to claim 1, wherein the secondary firing pin is integrally formed with the centrifugal trigger, the spring of the secondary firing pin being comprised by the return spring of the centrifugal trigger.

12. A priming and self-destruct system for a munition designed to be ejected from a cargo shell and having a sub-munition that rotates about a longitudinal axis of the munition, comprising:

a primer carried by a movable slide valve between a safety position and an armed position;

a main firing pin to initiate the primer;

a secondary self-destruct firing pin; and a self-destruct system comprising:

a centrifugal trigger pivotably mounted about an axis approximately parallel to the rotational axis of the munition, the centrifugal trigger being pivotable under the effect of centrifugal force against the action of a return spring between a central position and an outer position, and a retainer for securing the secondary self-destruct firing pin, the retainer having its own spring, the retainer being maintained in an armed position once the centrifugal trigger pivots to its outer position, the retainer being released by the centrifugal trigger once the munition stops rotating and the centrifugal trigger pivots to its central position under the action of its return spring, and the secondary firing pin thereafter causing the radial percussion of the primer through an opening in the slide valve.

13. A priming and self-destruct system for a munition comprising:

a body for holding a war charge, said body being cylindrical and having a first end, a longitudinal axis, a first transverse axis, and a second transverse axis, said first transverse axis intersecting said second transverse axis to form an included angle of less than 90 degrees;

a slide disposed within a channel adjacent said first end of said body, said slide being movable in a direction parallel to said first transverse axis between a safety position and an armed position, said slide having a first end and a second end, said first end having a recess disposed therein;

a primer disposed within said recess of said slide;

a main firing pin disposed along said longitudinal axis adjacent said slide, said main firing pin being disposed to actuate said primer through a first opening when said slide is in said armed position; and a self-destruct system comprising:

a secondary firing pin movable along said second transverse axis, said secondary firing pin being disposed to translate radially inward and actuate said primer through a second opening in said slide when said slide is in said armed position; and a centrifugal trigger pivotable about a trigger axis between a central position and an outer position, said trigger axis being parallel to said longitudinal axis and passing through a point near the periphery of said body, said centrifugal trigger having a first end and a second end, said first end being pivotable from said central position to said outer position under the action of centrifugal force and against the action of a spring, said first end engaging and preventing the movement of said slide when said centrifugal trigger is in said central position, said second end engaging and preventing the movement of said secondary firing pin when said centrifugal trigger is in said outer position.

14. A primary and self-destruct system for a munition designed to be fired out of a barrel of a weapon having a body for holding a war charge, a slide containing a primer, and a main firing pin, said self-destruct system comprising:

a secondary firing pin movable along a transverse axis, said secondary firing pin being disposed to translate radially inward and actuate said primer through a second opening in said slide when said slide is in said armed position; and a centrifugal trigger pivotable about a trigger axis between a central position and an outer position, said trigger axis being parallel to a longitudinal axis and passing through a point near the periphery of said body, said centrifugal trigger having a first end and a second end, said first end being pivotable from said central position to said outer position under the action of centrifugal force and against the action of a spring, said first end engaging and preventing the movement of said slide when said centrifugal trigger is in said central position, said second end engaging and preventing the movement of said secondary firing pin when said centrifugal trigger is in said outer position.

* * * * *